US005768718A

United States Patent [19]

Sorimachi

[11] Patent Number: 5,768,718

[45] Date of Patent: Jun. 23, 1998

[54] CONTROL DEVICE FOR CONTROLLING THE SEAT OR THE SEAT LID OF A TOILET BOWL

[75] Inventor: Akira Sorimachi, Yokohama, Japan

[73] Assignee: Katoh Electrial Machinery Co., Ltd., Yokohama, Japan

[21] Appl. No.: 506,951

[22] Filed: Jul. 26, 1995

[51] Int. Cl.[6] ..... A47K 13/12

[52] U.S. Cl. ..... 4/236; 4/246.2

[58] Field of Search ..... 4/246.1, 246.2, 4/246.3, 246.4, 246.5, 248, 236; 188/297, 300, 306, 307

[56] References Cited

U.S. PATENT DOCUMENTS

| | | | |
|---|---|---|---|
| 1,993,625 | 3/1935 | Riemer et al. | 4/248 |
| 4,768,630 | 9/1988 | Aubry et al. | 188/307 |
| 5,153,946 | 10/1992 | Yoke et al. | 4/246.1 |
| 5,279,000 | 1/1994 | Mercier et al. | 4/246.1 |

FOREIGN PATENT DOCUMENTS

| | | | |
|---|---|---|---|
| 3437138 | 4/1986 | Germany | 4/248 |
| 6-142005 | 5/1994 | Japan | 4/248 |

*Primary Examiner*—Charles R. Eloshway
*Attorney, Agent, or Firm*—Notaro & Michalos P.C.

[57] ABSTRACT

A hinge mechanism capable of making fluidic damping action ineffective or reducing fluidic damping action to the least possible extent so that the seat or the seat lid of a toilet bowl can be lightly raised when raising the seat or the seat lid, holds in the seat or the seat lid in a self-supporting state. Fluidic damping action is so that the seat or the seat lid can be turned gently when turning the seat or the seat lid to its fully lowered position and prevent damaging a fluid damping mechanism by overloading. The hinge mechanism comprises: a bracket fixedly mounted on the toilet bowl; a shaft having one end fixedly supported on the bracket, and extended in a horizontal position; a rotary drum coaxially and rotatably mounted on the shaft so as to be slightly axially slidable to hold the seat or the seat lid; a compression spring wound around the shaft and compressed in an annular space between the shaft and the rotary drum to bias the rotary drum in one direction; and a fluid damping mechanism disposed between the stationary shaft and the rotary drum and provided with valves.

9 Claims, 13 Drawing Sheets

CONTROL DEVICE FOR CONTROLLING THE SEAT OR THE SEAT LID OF A TOILET BOWL

FIELD OF THE INVENTION

The present invention relates to a hinge mechanism capable of damping the turning motions of the seat or the seat lid of a toilet bowl so that the seat or the seat lid may not fall naturally or suddenly.

DESCRIPTION OF THE RELATED ART

A hinge mechanism of the kind disclosed in Japanese Utility Model Publication No. 4-38799, Sep. 10, 1992 comprises brackets detachably attached to a toilet bowl, a casing formed integrally with the brackets, a hinge shaft rotatably supported on the casing, a stationary plate capable of turning together with the hinge shaft and having an L-shaped cross section, a seat having brackets attached to the hinge shaft and fixed to a flat portion of the stationary plate, and a damping means disposed inside the casing to damp the turning motion of the hinge shaft. The damping means comprises a cam member mounted on the hinge shaft and having a cam surface provided with projections and recesses for holding the seat in a half raised position, an elastic means continuously pressed against the cam surface, and a torsion coil spring wound around the hinge shaft and resiliently strained between the hinge shaft and the casing. The damping means holds the seat securely in a fully raised position or a half raised position, and prevents the sudden fall of the seat when closing the seat.

A lid damping mechanism disclosed in U.S. Pat. No. 5,222,260 granted to Dean E. Piper comprises:

- a lid shaft means for mounting a lid on a toilet bowl, connected to the lid and supported for rotation in a pair of bearings;
- a right and a left cylinder means firmly attached to the bearings to the toilet bowl;
  - the pair of bearings, a left sliding cam member, a right sliding cam member, and a right and a left resilience adjusting screw means for biasing the sliding cam members toward the rotating shaft; and
- a sliding cam member having opposite ends forming cam surfaces that cooperate with the right and the left sliding cam members.

When the lid is turned from a fully raised position to a fully lowered position, the right and the left sliding cam members are pushed outward against the resiliences of the right and the left spring means to regulate the falling speed of the lid falling onto the toilet bowl.

OBJECT OF THE INVENTION

It is an object of the present invention to provide a hinge mechanism capable of making fluidic damping action ineffective or reducing fluidic damping action to the least possible extent so that the seat or the seat lid of a toilet bowl can be lightly raised when raising the seat or the seat lid, of securely holding the seat or the seat lid in a fully raised position, of making fluidic damping action effective so that the seat or the seat lid can be turned gently when turning the seat or the seat lid to its fully lowered position and of preventing damaging a fluid damping mechanism by overloading.

DESCRIPTION OF THE PREFERRED EMBODIMENTS

Figure 1:
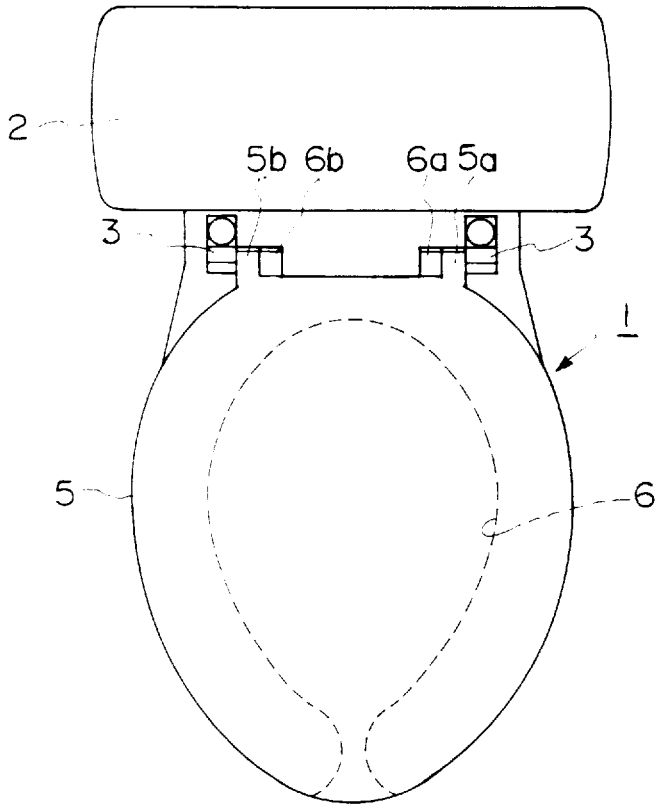
FIG. 1 is a plan view of a toilet bowl incorporating a preferred embodiment of the present invention.
Figure 2:
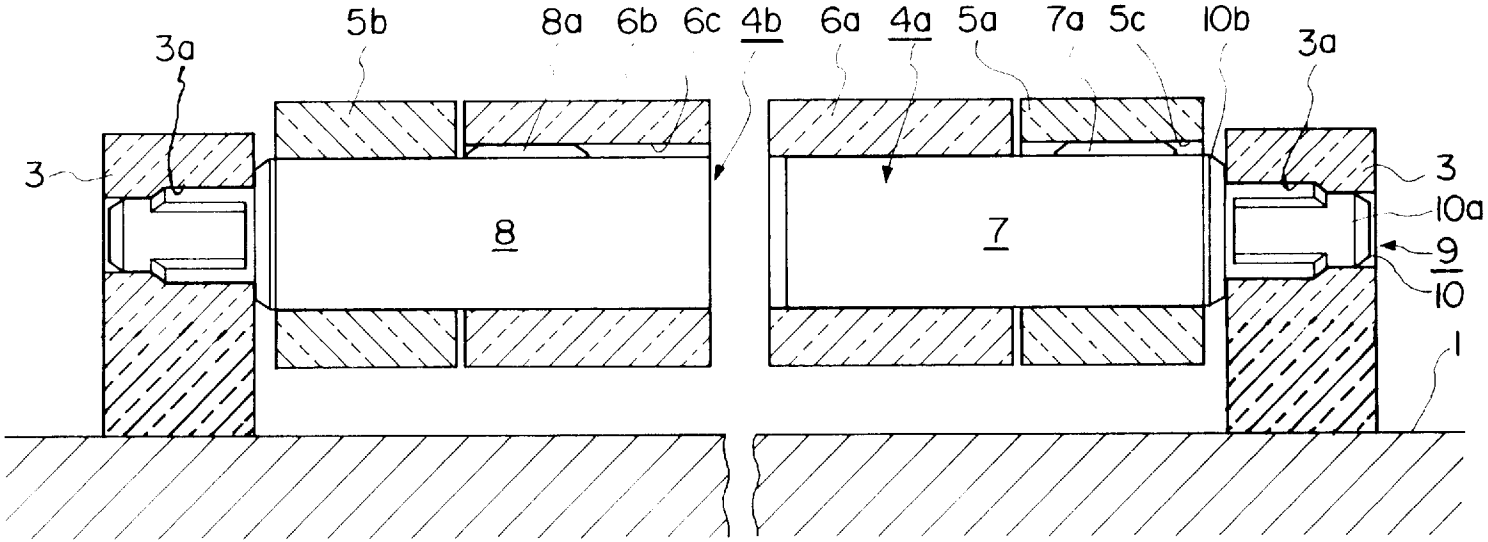
FIG. 2 is a longitudinal sectional view of a seat lid controlling hinge mechanism and a seat controlling hinge mechanism in a preferred embodiment according to the present invention for damping the turning motions of the seat lid and the seat of a toilet bowl.

The accompanying drawings show the preferred embodiments of the present invention. In FIGS. 1 and 2, indicated at 1 is a toilet bowl and at 2 is a water tank. A pair of brackets 3 are fixed to the toilet bowl 1 at positions on the opposite sides of the back end of the upper surface of the toilet bowl 1, respectively, a seat lid controlling hinge mechanism 4*a* and a seat controlling hinge mechanism 4*b* are fixedly held on the brackets 3, respectively, each at its one end, and a seat lid 5 and a seat 6 are attached to the hinge mechanisms 4*a* and 4*b* so as to be turned relative to the toilet bowl 1. The respective knuckles 5*a* and 6*b* of the seat lid 5 and the seat 6 are provided with keyways 5*c* and 6*c*, respectively, and splines 7*a* and 8*a* formed on the outer circumferences of rotary drums 7 and 8 (FIG. 2) are engaged with the keyways 5*c* and 6*c* of the seat lid 5 and the seat 6 to restrain the knuckles 5*a* and 6*b* from turning relative to the rotary drums 7 and 8, respectively. The respective knuckles 5*b* and 6*a* of the seat lid 5 and seat 6 are put on the rotary drums 8 and 7 for free turning relative to the rotary drums 8 and 7, respectively. The rotary drum 7 of the seat lid controlling hinge mechanism 4*a* turns when the seat lid 5 is turned, and the rotary drum 8 of the seat controlling hinge mechanism 4*b* turns when the seat 6 is turned.

FIGS. 3 to 9 show the internal configuration and the function of the seat lid controlling hinge mechanism 4*a* on the right side in FIG. 2. Although the seat lid controlling hinge mechanism 4*a* is described hereinafter, the seat controlling hinge mechanism 4*b* of the left side in FIG. 2 is substantially the same in construction as the seat lid controlling hinge mechanism 4*a* excluding part of the construction.

Referring to FIGS. 3 to 9, a stationary shaft 9 is formed by combining a first stationary shaft member 10 and a second stationary shaft member 12. The bracket 3 is provided with an irregular formed bore 3*a*, and outer end 10*a* of the first stationary shaft member 10, having a shape complementary to the irregular formed bore 3*a* is fixedly fitted in the irregular formed bore 3*a*. The outer end of the second stationary shaft member 12 is fitted in the axial bore 10 of the first stationary shaft member 10 and is fastened to the first stationary shaft member 10 with a screw 10*c*. The first stationary shaft member 10 has a flange 10*b*, and an inner end portion 10*e* inserted in the rotary drum 7. Sealing members 11 and 13, such as O rings, are disposed for sealing between the outer circumference of the inner end portion 10*e* of the first stationary shaft member 10 and the inner circumference of the rotary drum 7.

Figure 4:
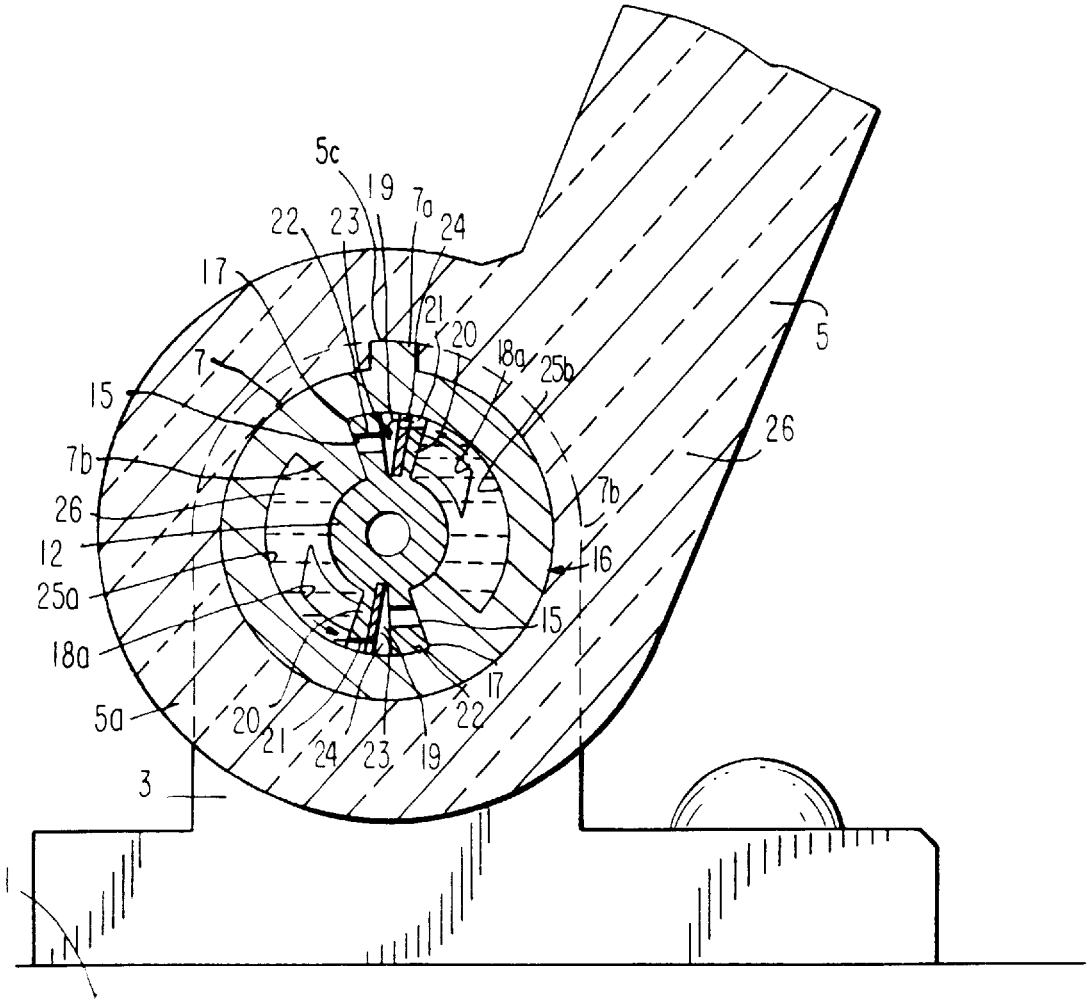
FIG. 4 is a full sectional side view of the seat lid controlling hinge mechanism as it would be seen if viewed in the direction indicated by a plane 4—4 in FIG. 3, for assistance in explaining a fluid damping mechanism, in which a seat lid is in a fully raised position.
Figure 5:
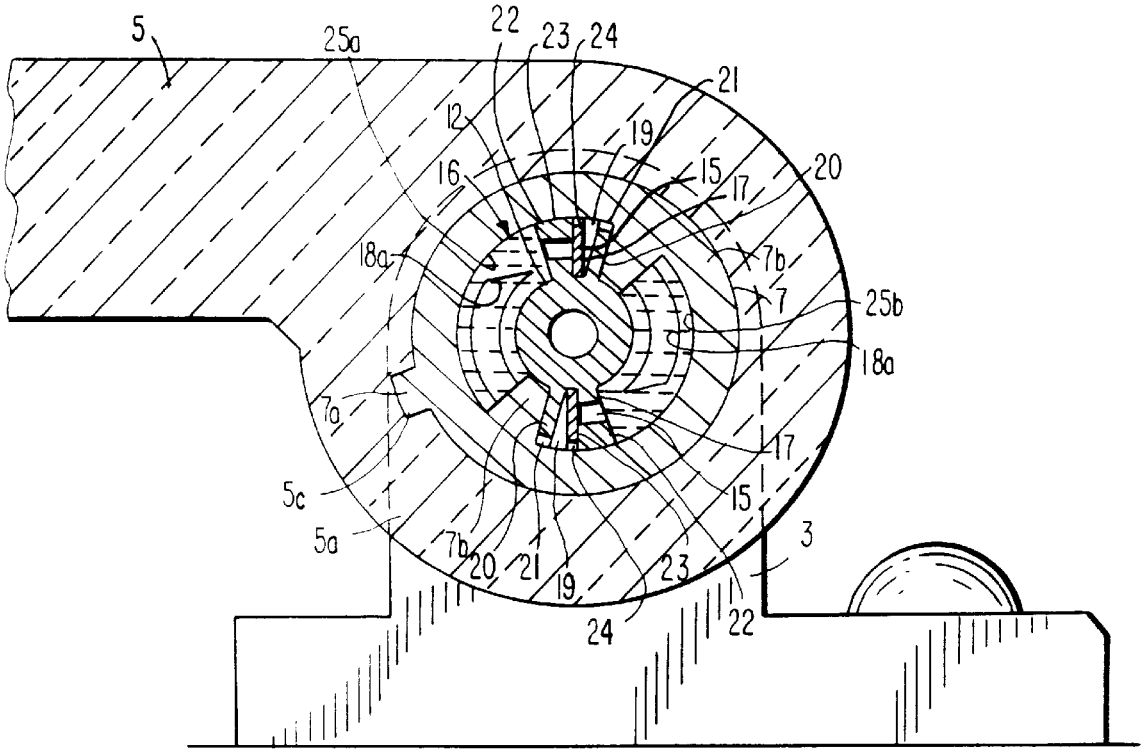
FIG. 5 is a sectional side view of the seat lid controlling hinge mechanism similar to FIG. 4, for assistance in explaining the fluid damping mechanism, in which the seat lid is in a fully lowered position.
Figure 6:
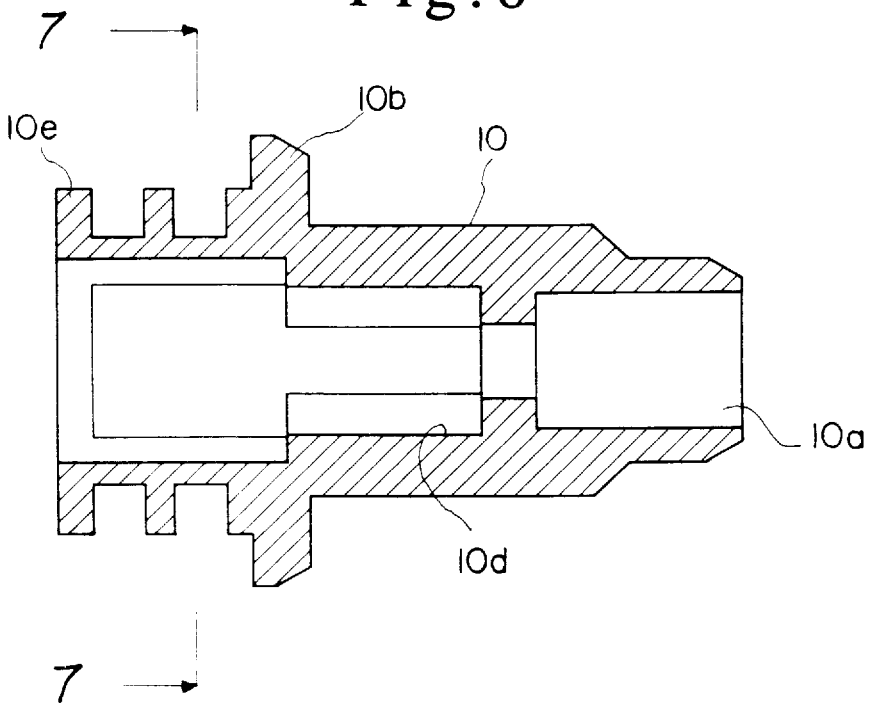
FIG. 6 is a longitudinal sectional view of a first stationary, shaft.
Figure 7:
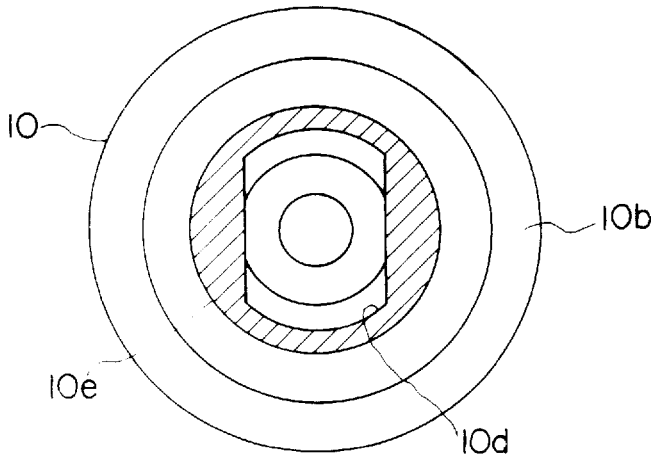
FIG. 7 is a sectional view taken on line 7—7 in FIG. 6.
Figure 8:
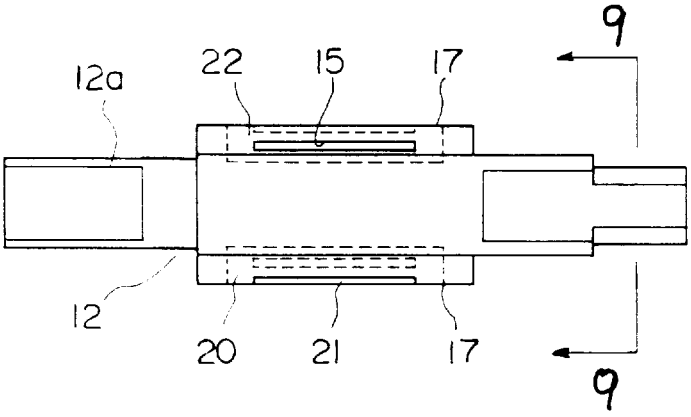
FIG. 8 is a front view of a second stationary shaft.
Figure 9:
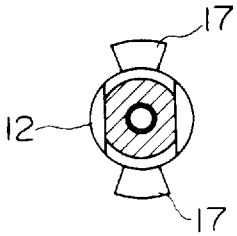
FIG. 9 is a sectional view taken on line 9—9 in FIG. 8.
Figure 10:
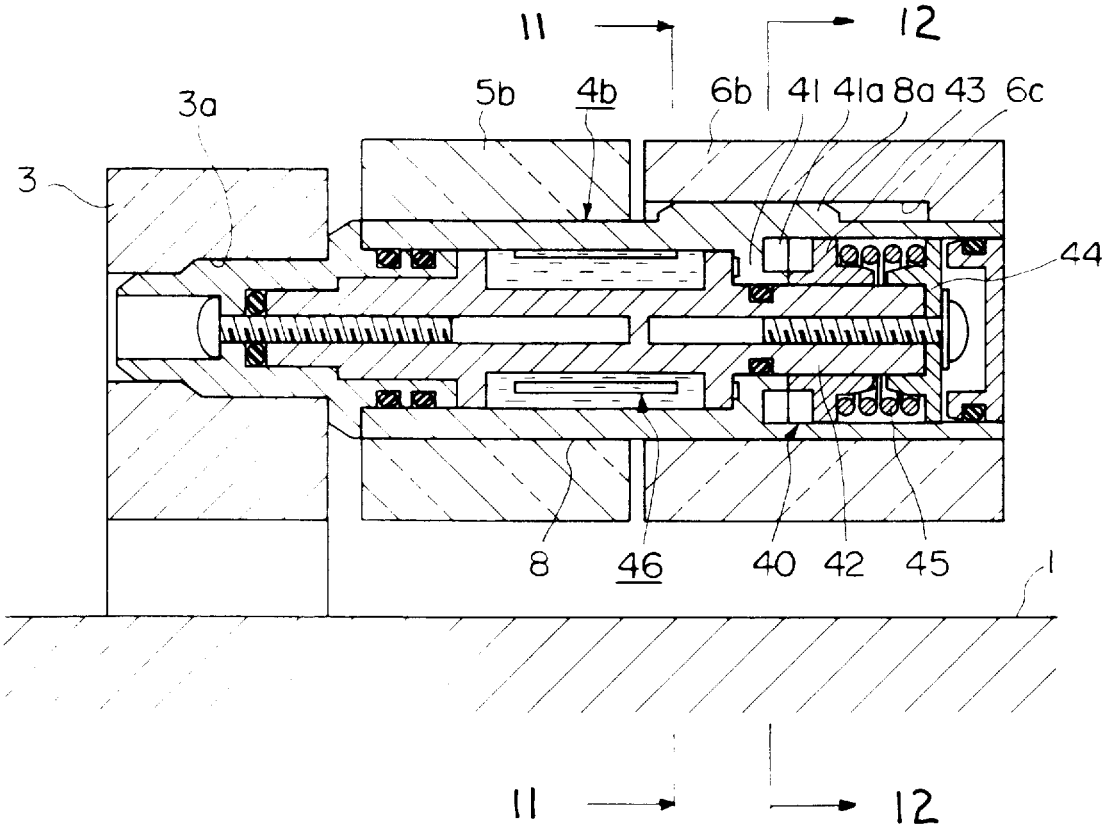
FIG. 10 is a longitudinal sectional view of the seat controlling hinge mechanism with the seat and lid not shown for clarity.
Figure 11:
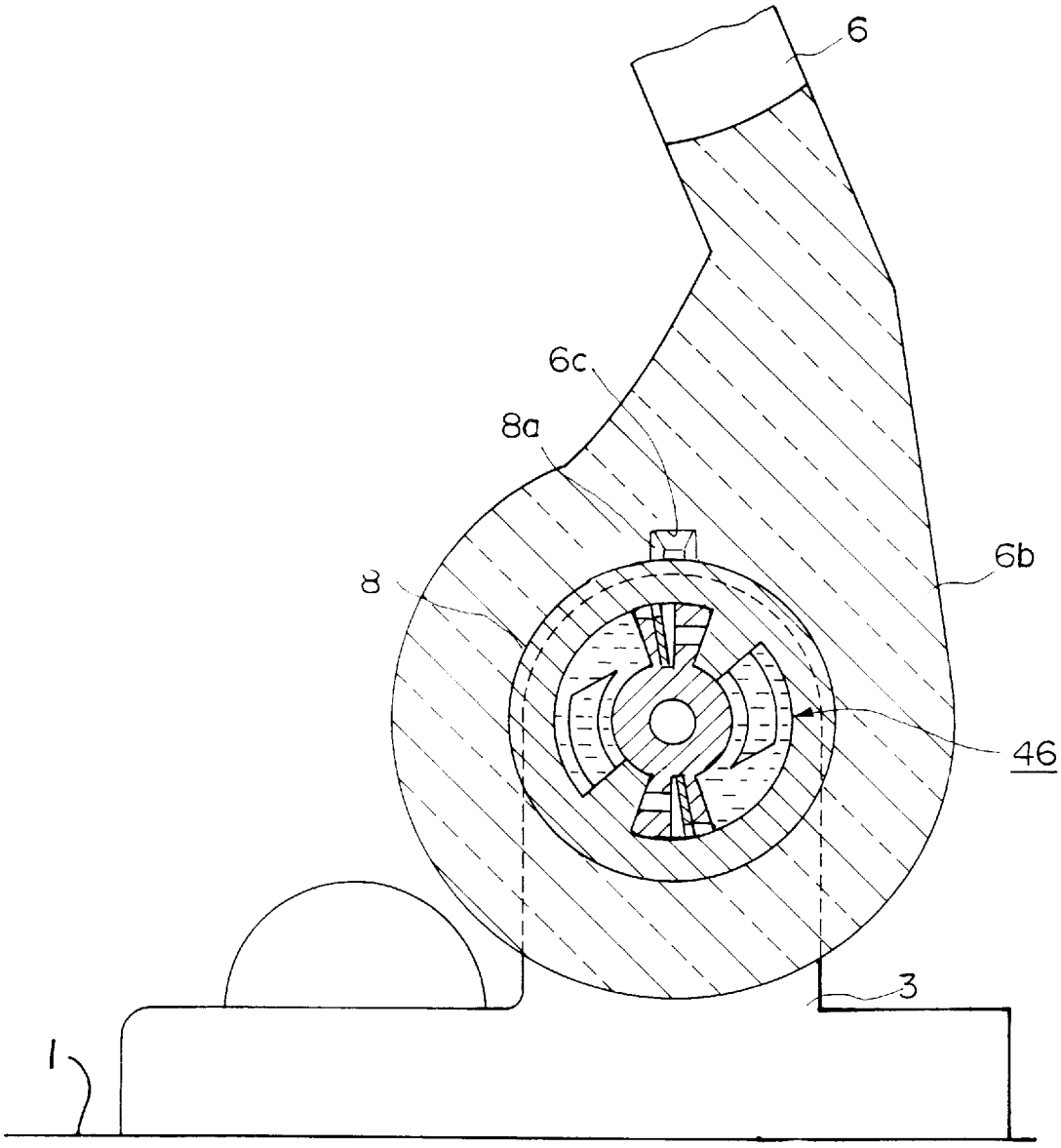
FIG. 11 is a sectional side view of the seat controlling hinge mechanism as it would be seen if viewed in the direction indicated by plane 11—11 in FIG. 10, for assistance in explaining a fluid damping mechanism, in which the seat is in a fully raised position.

A fluid damping mechanism 16 will be described hereinafter. Valves 17 are disposed diametrically opposite to each other in the substantially middle portion of the second stationary shaft member 12. The valves 17 are contiguous with the inner circumference of the rotary drum 7, the end on the side of the inner end portion 10*e* of the first stationary shaft member 10, and an inner flange 18 formed on the inner circumference of the rotary drum 7. As shown in FIG. 4, each of the valves 17 has a first valve ridge 20, a second valve ridge 22, an axial groove 19 formed between the first valve ridge 20 and the second valve ridge 22, a valve element 23 disposed in the axial groove 19, and an arcuate groove 18*a* formed in the inner flange 18. The first valve ridge 20 is provided in its outer end with a first recess 21, the second valve ridge 22 is provided with an axial slot 15, and the valve element 23 is provided with a second recess 24 of a size equal to that of the first recess 21. A pair of blades 7*b* project from portions of the inner circumference of the rotary drum 7 corresponding to the valves 17 into a pair of cylinder chambers 25*a* and 25*b* partitioned by the pair of valves 17, respectively. The inner ends of the pair of blades 7*b* are in contact with the outer surface of the second shaft member 12. The cylinder chambers 25*a* and 25*b* are filled up with a viscous fluid 26, such as silicone oil. The axially opposite ends of each blade 7*b* are in contact with the inner flange 18 and the end surface of the inner end portion 10*e* of the first stationary shaft member 10, respectively.

A sealing member 27, such as an O ring, is disposed for sealing between the outer circumference of the second stationary shaft member 12 and the inner flange 18. A spring seat 28 is fastened with a screw 29 to the inner end of the second stationary shaft member 12. A sliding member 30 is mounted on a reduced portion 12 opposite to the spring seat 28. The sliding member 30 is axially slidable and is restrained from rotation. A helical compression spring 31 is wound around the reduced portion 12 and is compressed between the spring seat 28 and the sliding member 30. A plug 32 is fitted in the inner end of the rotary drum 7, and a sealing member 33 is disposed for sealing between the rotary drum 7 and the plug 32.

The knuckle 6*a* of the seat 6 is supported for rotation on the rotary drum 7 of the seat lid controlling hinge mechanism 4*a*, and hence the seat lid controlling hinge mechanism 4*a* serves simply as a bearing mechanism when the seat controlling hinge mechanism 4*b* is operated.

Since the knuckle 5*a* of the seat lid 5 is fixedly mounted on the rotary drum 7, the rotary drum 7 turns on the stationary shaft 9 when the seat lid 5 is turned. When the seat lid 5 is turned upward, the blades 7*b* turn counterclockwise from the positions shown in FIG. 5. Then, the valve elements 23 are shifted in the axial grooves 19 from positions on the side of the corresponding second ridges 22 toward the corresponding first ridges 20, respectively, so that the axial slots 15 are opened to form passages for the viscous fluid 26 through the axial slots 15, the second recesses 24 and the first recesses 21. Consequently, the viscous fluid 26 flows smoothly from the cylinder chamber 25*a* into the cylinder chamber 25*b*, and from the cylinder chamber 25*b* into the cylinder chamber 25*a*, and hence the fluidic damping function of the fluid damping mechanism 16 is ineffective or the fluidic damping function is exerted slightly. Therefore, the upward turning of the seat lid 5 is not encountered by a large resistance. When the seat lid 5 is turned downward, the valve elements 23 are shifted in the reverse direction from positions shown in FIG. 5 toward the second ridges 22 to close the axial slots 15. Consequently, the viscous fluid 26 is able to flow only around valves 17 through the arcuate grooves 18*a*, so that the fluidic damping function of the fluid damping mechanism 16 becomes effective. Therefore, the seat lid 5 is unable to turn quickly downward and turns gradually downward. Since the fluid damping mechanism 16 has no ability to bias the seat lid 5 upward, the seat lid 5 is not separated from the seat 6.

Figure 3:
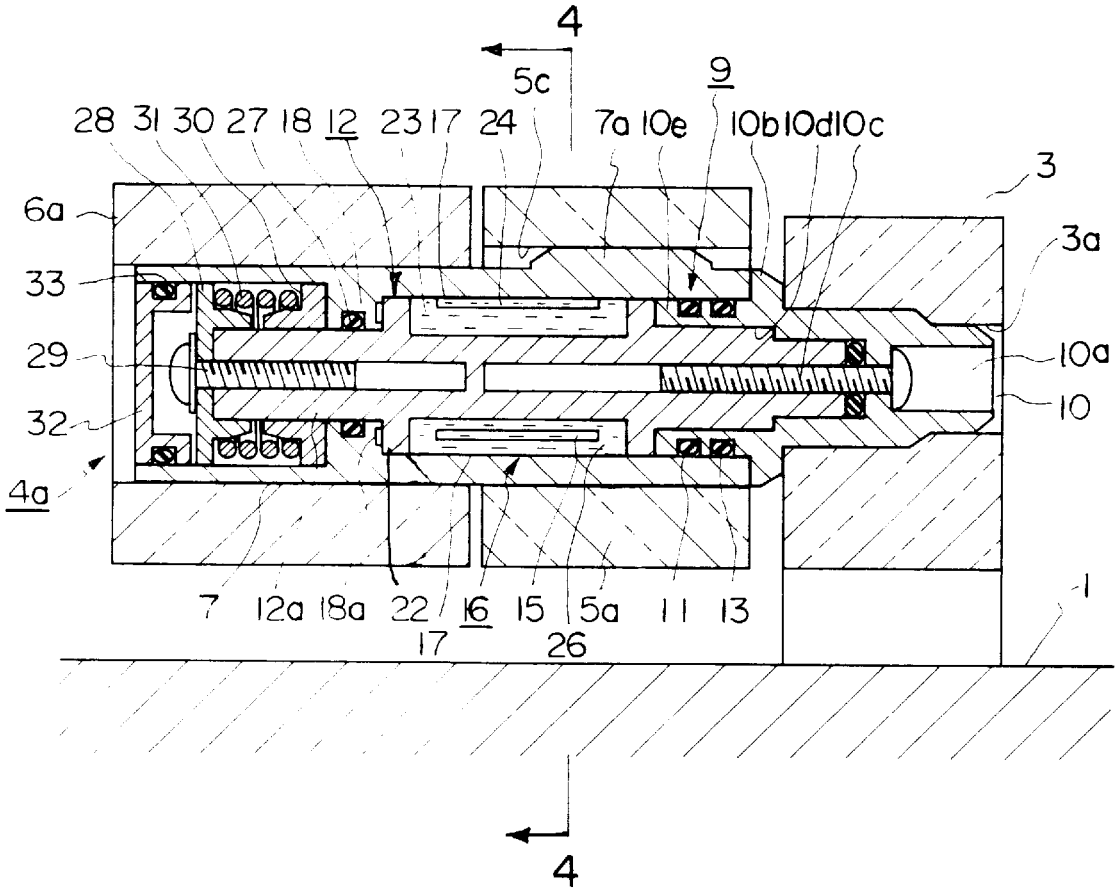
FIG. 3 is a longitudinal sectional view of the seat lid controlling hinge mechanism as set at a working position with the seat and lid not shown for clarity.

If the rotary drum 7 is overloaded due to the quick turning of the seat lid 5, the rotary drum 7 is caused to slide axially from the position shown in FIG. 3 toward the left, as viewed in FIG. 3, against the resilience of the helical compression spring 31 by the pressure of the viscous fluid 26 forced by the blades 7*b* suddenly to flow from one of the cylinder chambers into the other through the arcuate grooves 18*a*. Consequently, the volumes of the cylinder chambers 25*a* and 25*b* are increased, the pressure of the viscous fluid 26 filling up the cylinder chambers decreases and hence the fluid damping mechanism 16 is not broken. After the excessive load on the rotary drum 7 has been removed, the rotary drum 7 is caused to slide to its original position by the resilience of the helical compression spring 31.

Figure 15:
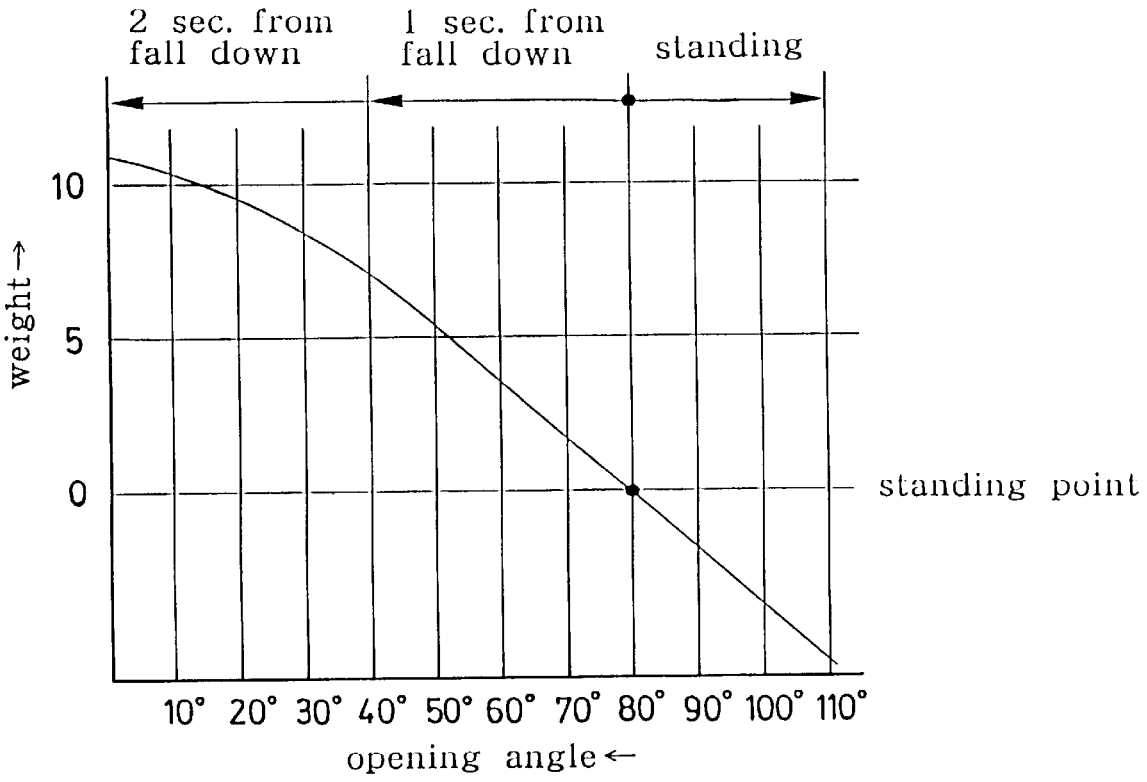
FIG. 15 is a graph showing the variation of moment with the angular position of the seat lid when the seat lid is lowered.

FIG. 15 shows the variation of the moment of the seat lid 5 about the axis of the seat lid controlling hinge mechanism 4*a* with the inclination of the seat lid 5. The seat lid 5 reaches a self-supporting state when the inclination of the seat lid 5 is 80°. The maximum inclination of the seat lid 5 is 110°. When the seat lid 5 is pushed for downward turning, the seat lid 5 turns downward at relatively high angular speeds from the self-supporting inclination of 80° to an inclination of 40° in about one second, and then turns gradually downward to an inclination of 0° at relatively low angular speeds in two seconds.

Figure 12:
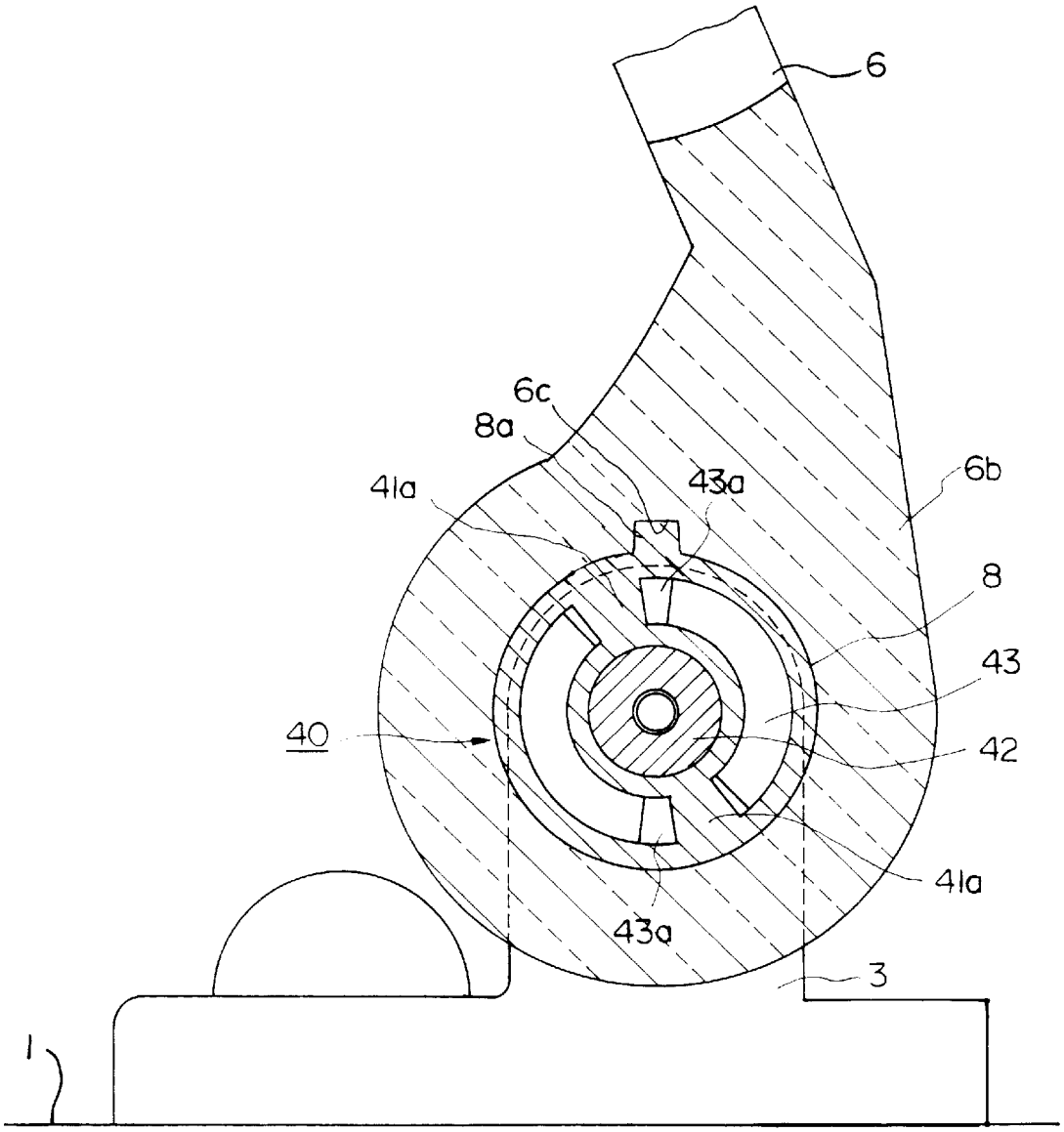
FIG. 12 is a full sectional side view of the seat controlling hinge mechanism as it would be seen if viewed in the direction indicated by plane 12—12 in FIG. 10, for assistance in explaining the function of a cam mechanism, in which the seat is in a fully raised position.
Figure 13:
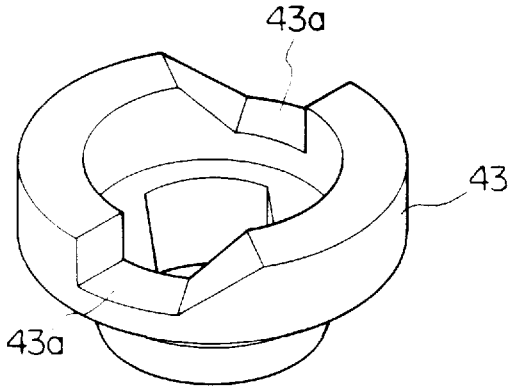
FIG. 13 is a perspective view of a sliding member included a cam mechanism.
Figure 14:
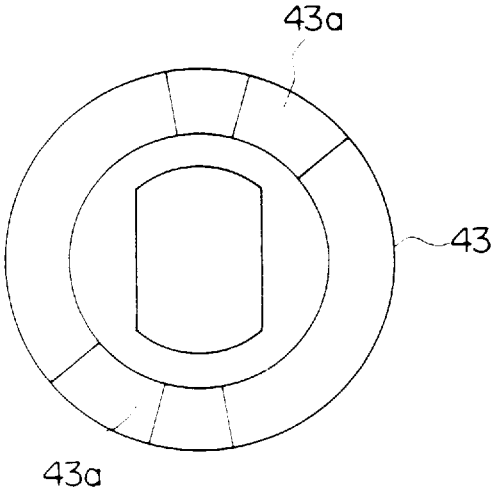
FIG. 14 is a plan view of the sliding member of FIG. 13.

FIGS. 10 to 14 show the internal configuration of the seat controlling hinge mechanism 4*b* for controlling the turning of the seat 6 of FIG. 2. The construction of the seat controlling hinge mechanism 4*b* is substantially the same as that of the seat lid controlling hinge mechanism 4*a*, except that the seat controlling mechanism 4*b* is provided with a cam mechanism 40. As best shown in FIG. 12, the cam mechanism 40 comprises a pair of projections 41*a* formed on one side of the inner flange 41 of the rotary drum 8 on the opposite sides, respectively, of a stationary shaft 42, a sliding member 43 provided with recesses 43*a* and slidably mounted on the stationary shaft 42 and restrained from rotation, and a helical compression spring 45 wound around the stationary shaft 42 and compressed between a spring seat 44 fixed to the inner end of the stationary shaft 42 and the sliding member 43 so as to press the sliding member toward the inner flange 41. When the seat 6 is inclined at an inclination in the range of self-supporting inclination of 80° to 110°, the projections 41*a* are received in the recesses 43*a* of the sliding member 43 slidably mounted on the stationary shaft 42 and restrained from rotation to keep the seat 6 in a stable self-supporting state. The construction and the function of the seat controlling hinge mechanism 4*b* are the same as those of the seat lid controlling hinge mechanism 4*a* in other respects. When the rotary drum 8 is overloaded, the rotary drum 8 is shifted slightly toward the right, as viewed in FIG. 10 to avoid the breakage of a fluid damping mechanism 46.

Figure 16:
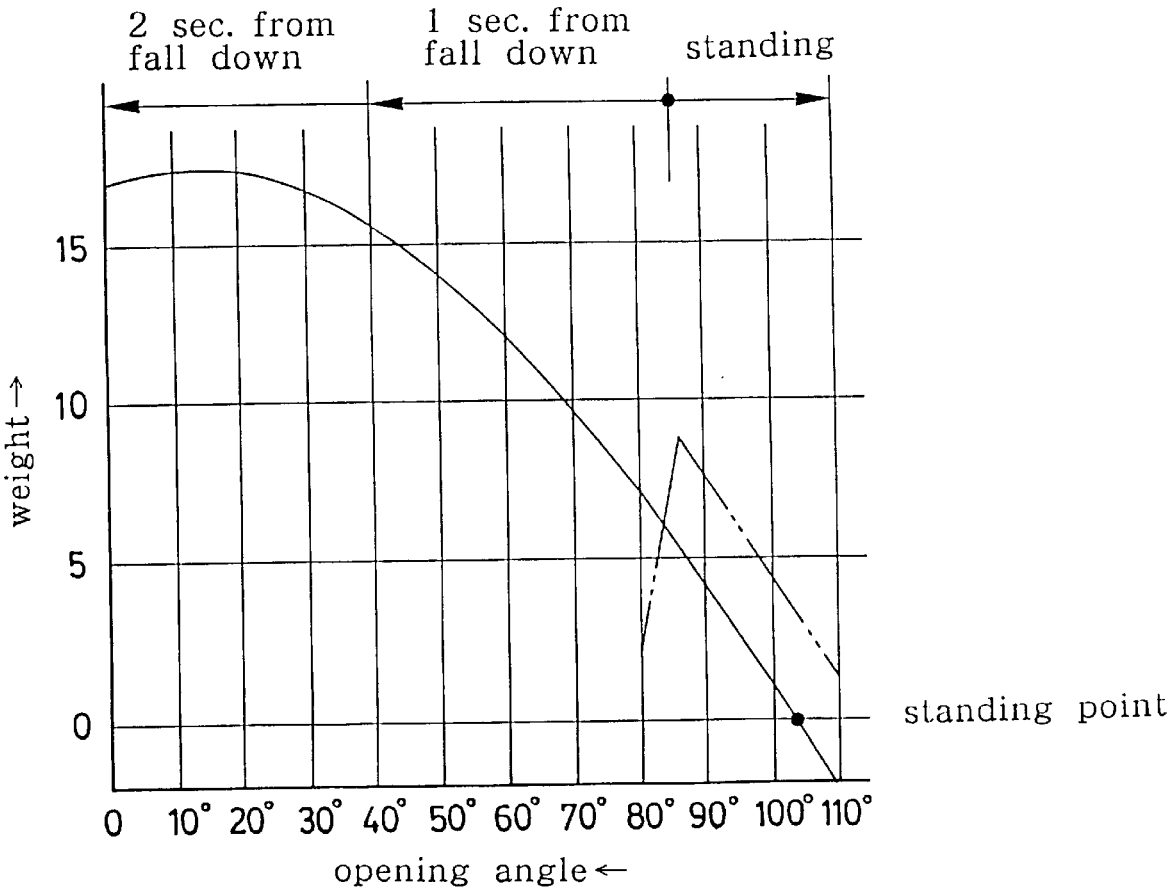
FIG. 16 is a graph showing the variation of moment with the angular position of the seat when the seat is lowered.

FIG. 16 shows the variation of the moment of the seat 6 about the axis of the seat controlling hinge mechanism 4*b* with the inclination of the seat 6. The seat 6 reaches a self-supporting state when the inclination of the seat 6 is 80°. The maximum inclination of the seat 6 is 110°. Since the cam mechanism 40 applies a braking force exceeding the torque to the seat 6, the seat 6 can be held very stably in the self-supporting state. When the seat 6 is pushed for downward turning, the seat 6 turns downward at relatively high angular speeds from the self-supporting inclination of 80° to an inclination of 40° in about one second, and then turns gradually downward to an inclination of 0° at relatively low angular speeds in two seconds.

What is claimed is:

1. A hinge mechanism for supporting a knuckle of at least one of a seat lid and a seat of a toilet bowl, said hinge mechanism comprising:

a bracket adapted to be fixedly mounted on a toilet bowl;

a stationary shaft having one end fixedly supported on the bracket, and extended in a horizontal position;

a rotary drum having one closed end and an outer circumference, a securing projection on the outer circumference of the rotary drum, the rotary drum being axially slidably and rotatably mounted on the stationary shaft, and holding the knuckle so as to be turned when the at least one of the seat lid and the seat is turned;

a fluid damping mechanism having at least two valves and being connected between the stationary shaft and the rotary drum, the rotary drum having an inner flange with a side surface and the rotary drum defining a cylindrical chamber for receiving a fluid, each of the valves comprising: a first valve ridge and a second valve ridge, the valve ridges being connected to and extending radially from the stationary shaft into the cylindrical chamber and sliding over the side surface of the rotary drum with rotation of the rotary drum with respect to the stationary shaft; each valve having an axial groove between the first valve ridge and the second valve ridge; each second valve ridge having an axial slot therethrough; each first valve ridge having on outer edge with a recess therein; a valve element mounted for movement in each axial groove, between a closing position against the second valve ridge for closing the axial slot, and an open position spaced from the second valve ridge for opening the axial slot for passage of fluid in the chamber; and an arcuate groove adjacent the first and second valve ridges of each valve, each arcuate groove being in the side surface of the inner flange; and a compression spring wound around the stationary shaft and compressed in an annular space between the stationary shaft and the rotary drum to bias the rotary drum in one direction so that the valve ridges are pressed against the side surface of the inner flange of the rotary drum: the rotary drum being movable in an opposite direction for allowing passage of fluid in the chamber along each arcuate groove.

2. A hinge mechanism according to claim 1, including a cam mechanism between the drum and the shaft, movable using the resilience of the compression spring for controlling turning of the rotary drum, the spring being a helical compression spring.

3. A hinge mechanism according to claim 1, wherein said fluid damping mechanism comprises:

a viscous fluid filling the chamber; and a plurality of blades projecting radially inwardly from an inner circumference of the rotary drum and into contact with the stationary shaft.

4. A hinge mechanism according to claim 1, wherein said stationary shaft comprises: a first shaft member having a flange, a first portion extending on one side of the flange and fixedly held on the bracket, and a second portion extending on another side of the flange and inserted in the rotary drum; and a second shaft member coaxially and fixedly connected to the second portion of the first shaft member inserted in the rotary drum.

5. A hinge mechanism according to claim 1, wherein said fluid damping mechanism comprises: a viscous fluid filling up the chamber; and blades projecting radially inward from an inner circumference of the rotary drum, into contact with the surface of the stationary shaft;

said stationary shaft comprising: a first shaft member having a flange, a first portion extending on one side of the flange and fixedly held on the bracket, and second portion extending on the other side of the flange and inserted in the rotary drum; and a second shaft member coaxially and fixedly connected to the first portion of the first shaft member inserted in the rotary drum.

6. A hinge mechanism according to claim 1, including a cam mechanism using the resilience of the compression spring for controlling the turning of the rotary drum, the spring being a helical compression spring; and said fluid damping mechanism comprising: a viscous fluid filling up the chamber; and blades projecting radially inward from the inner circumference of the rotary drum so that their extremities are in contact with the surface of the stationary shaft.

7. A hinge mechanism according to claim 1, including a cam mechanism for using the resilience of the compression spring for controlling the turning of the rotary drum, the spring being a helical compression spring; and said cam mechanism comprising: a sliding member slidably mounted on the stationary shaft and provided with projections on one side surface thereof and the rotary drum provided with recesses that mate with the projections of the sliding member when the one of the seat lid or the seat is at an inclination.

8. A hinge mechanism according to claim 1, including a cam mechanism using the resilience of the compression spring for controlling the turning of the rotary drum; and said stationary shaft comprising: a first shaft member having a flange, one portion extending on one side of the flange and fixedly held on the bracket, and the other portion extending on the other side of the flange and inserted in the rotary drum; and a second shaft member coaxially and fixedly connected to the portion of the first shaft member inserted in the rotary drum.

9. A hinge mechanism according to claim 1, including a cam mechanism using the resilience of the compression spring for controlling the turning of the rotary drum, the spring being a helical compression spring; and said fluid damping mechanism comprising: a viscous fluid filling up the chamber; and blades projecting radially inward from the inner circumference of the rotary drum so that their extremities are in contact with the surface of the stationary shaft;

said cam mechanism comprising: a sliding member slidably mounted on the stationary shaft and provided with recesses or projections on one side surface thereof, and the rotary drum provided with projections or recesses that mate with the recesses or the projections of the sliding member when the seat lid or the seat is at an inclination in a predetermined range of inclination, and a compression spring compressed so as to bias the sliding member and the rotary drum in one direction.

* * * * *